United States Patent [19]

Linder et al.

[11] Patent Number: 4,667,639

[45] Date of Patent: May 26, 1987

[54] DISTRIBUTOR INJECTION PUMP FOR INTERNAL COMBUSTION ENGINES

[75] Inventors: Ernst Linder, Mühlacker; Walter Schlagmüller, Schwieberdingen, both of Fed. Rep. of Germany

[73] Assignee: Robert Bosch GmbH, Stuttgart, Fed. Rep. of Germany

[21] Appl. No.: 840,649

[22] Filed: Mar. 17, 1986

[30] Foreign Application Priority Data

Jul. 25, 1985 [DE] Fed. Rep. of Germany ..... 3526629

[51] Int. Cl.[4] ..... F02M 59/44

[52] U.S. Cl. ..... 123/450; 417/462

[58] Field of Search ..... 123/357, 450, 458, 498; 417/462

[56] References Cited

U.S. PATENT DOCUMENTS 4,325,676 4/1982 Fenne et al. ..... 123/450 X
4,393,844 7/1983 Skinner ..... 123/450
4,463,727 8/1984 Babitzka et al. ..... 123/498 X
4,557,237 12/1985 Bally et al. ..... 123/450

FOREIGN PATENT DOCUMENTS 2060083 4/1981 United Kingdom ..... 123/450

*Primary Examiner*—Tony M. Argenbright
*Attorney, Agent, or Firm*—Michael J. Striker

[57] ABSTRACT

A distributor injection pump for internal combustion engines includes a high pressure pump for generating fuel injection pressure, a slide valve for defining fuel amounts to be injected and a piezoelectric adjustment member which actuates via a control chamber filled with fuel the slide of the slide valve. To prevent fomation of bubbles in the control chamber a rinsing conduit is provided, connected to the control chamber to rinse the latter. The rinsing conduit includes one portion connected to a fuel supply line and the other portion connected to a fuel return line leading to a fuel container.

11 Claims, 1 Drawing Figure

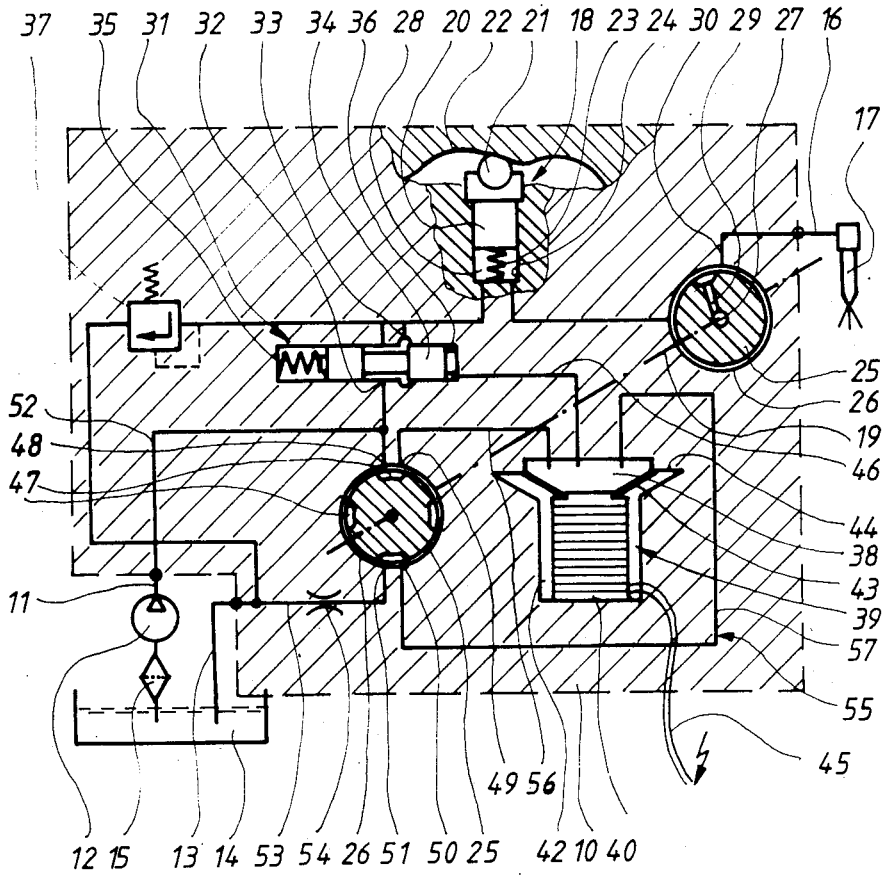
37
35
31
32
33
34
36
28
20
22
21
18
23
24
30
29
27
16
17
25
26
19
46
44
38
43
39
57
55
45
52
48
47
11
12
15
13
14
53
54
26
51
50
25
49
56
42
10
40

DISTRIBUTOR INJECTION PUMP FOR INTERNAL COMBUSTION ENGINES

BACKGROUND OF THE INVENTION

The present invention relates to a distributor injection pump for internal combusticn engines, particularly diesel motors.

Known distributor injection pumps of the type under consideration have a hydraulic control chamber which is subdivided by an adjustment piston, actuated by an adjustment member, into two portions which are continually hydraulically pressurized. The adjustment piston has two throttle gaps through which both pressure chambers are in connection with each other and with an initial hydraulic pressure. A slide valve normally provided in such a pump has two control chambers arranged at two end faces of the control slide, which chambers are connected with one of the two aforementioned portions of the hydraulic control chamber. If an exiting voltage is applied to the piezoelectric adjustment member the latter expands and displaces the adjustment piston. Pressure rises in one pressure chamber in a sudden manner and decreases in the other pressure chamber, also in the sudden fashion. Pressure in the control chambers changes in the same manner. The control slide is adjusted by the difference in pressures and the valve opens. If the exiting voltage is no longer applied to the adjustment member the adjustment member is displaced in the opposite direction. Pressure ratios in the pressure chamber portions and thus in the control chambers interchange, and the control slide is again brought to the open position.

The avoidance of the formation of gas bubbles in the pressure medium (diesel oil) of the hydraulic control chamber filled with fuel is obtained by that the pressure chambers are continually hydraulically prestressed. Due to a double-side acting adjustment piston, as opposed to one-side operating pistons, there is no danger that gas would drag in the pressure medium through the guidance gap. In order to overcome the problem of the length change of the piezoelectric adjustment member due to temperature fluctuations and various volume expansions of the pressure medium in the hydraulic control chamber the portions of the pressure chamber are connected to each other by a throttle gap; a hydraulic translation ratio of the cross-section of the piston to the cross-section of the control slide is greater than the ratio between the path of the control slide and the path of the piston, and the adjustment path of the control slide is limited by adjustable mechanical stops.

As studies have shown, despite such construction expenses and extremely quick strokes of the control slide and piezoelectric adjustment member over a longer period of time, the occurence of gas bubbles in the pressure medium of the hydraulic control chamber can not be totally avoided as desired. Gas bubbles in the hydraulic control chamber cause not only changes in the length of the piezoelectric adjustment member due to temperature fluctuations but also to an undesired adjustment of the injection start and/or end and thereby amounts of fuel being injected. Thus the distributor injection pump does not operate optimally.

SUMMARY OF THE INVENTION

It is an object of the present invention to provide an improved distributor injection pump for internal combustion engines.

This and other objects of the present invention are attained by a distributor injection pump for internal combustion engines, especially for diesel motors, comprising a high pressure pump alternatively operated in a suction phase for a fuel suction and a high pressure phase for generating a fuel injection pressure; a distributor for a series connection of the high pressure pump with aplurality of injection valves; a slide valve for determining an amount of fuel being injected, said slide valve having an inlet and an outlet and a control slide; a piezoelectric adjustment member; a control chamber provided between said adjustment member and said control slide for a hydraulic translation of an adjustment path of said adjustment member into displacement of said control slide; a housing; a fuel supply line; a fuel return line; and a rinsing conduit, said rinsing conduit including a first conduit portion connectable with said fuel supply line and opening into said control chamber and a second conduit portion connectable with said fuel return line, wherein a connection of said rinsing conduit with said fuel supply line and said fuel return line is established during the suction phase of the high pressure pump through said distributor.

The distributor may include a distributor shaft rotating with said high pressure pump and having a periphery, said housing having openings arranged at and opening towards the periphery of said shaft, a first opening being in connection with said fuel supply line, a second opening being in connection with said first conduit portion, a third opening being in connection with said second conduit portion and a fourth opening being in connection with said fuel return line, said distributor shaft being formed at said periphery with at least two control grooves, respectively corresponding to and cooperating with said openings, and wherein in at least one of rotation positions of said distributor shaft one of said control grooves is connected to said first and said second openings and the other of said control grooves is connected to said third and said fourth openings.

The advantage of the distributor injection pump of the invention resides not only in supressing the formation of gas bubbles to a much higher degree than known pumps of the foregoing type but also that the distributor injection pump can be substantially simpler in construction and thus less expensive. In place of high-priced double piston-slide valves a simple slide valve with a restoring spring can be used. An additional adjusting piston for generating two portions of the pressure chamber can be omitted.

Due to a continual rinsing or scavenging of the hydraulic control chamber during each suction phase of the high pressure pump the latter can be bubble-free.

Four openings may be arranged at said periphery pairwise, and a distance between said pairwise arranged openings, respectively, is selected so that upon rotation of said shaft a connection between said third and said fourth openings is temporarily interupted before the connection between said first and said second openings.

If now, in accordance with the scavenging or rinsing of the hydraulic control chamber, the separation of the first conduit portion of the rinsing conduit from the fuel return line would temporarily take place before the separation of the second portion of the rinsing conduit from the fuel supply line, the control pressure built-up would be always reliably at the same pressure level, and the time of reversal movement of the control slide in the slide valve would be stable.

Inasmuch as the control chamber is rinsed up or scavenged in each suction phase pressure compensation in the pressure medium is also obtained. The control pressure for the control slide in the slide valve builds up with each new energizing of the piezoelectric adjustment member. Thus changes in length of the piezoelectric adjustment member due to temperature fluctuations are completely compensated for and can not be unfavorably affect amounts of fuel being injected.

The number of said control grooves may correspond to the number of said injection valves, said control grooves being spaced at said periphery by an equal rotation angle and each extending circumferentially of said shaft at the same rotation angle.

Throttle means may be provided in the pump.

The throttle means may be formed in said second conduit portion or in the fuel return line.

The pump may further include a plate spring which limits said control chamber, said piezoelectric adjustment member being centrally secured to said spring.

Due to the provision of the plate spring a favorable translation ratio of the adjustment path of the piezoelectric adjustment member to the path of displacement of the control slide is obtained. The plate spring serves as a prestressing spring of the adjustment member and replaces a customary sheet spring. The plate spring in contrast to a sheet spring is massive and friction-free and makes short switching periods possible. This spring also serves as a control chamber limitation and replaces a limiting piston connected to the adjustment member as utilized up till now. The plate spring is inexpensive and leackage-free.

A pressure-limiting valve may be provided, which is in connection with said inlet.

The control slide of said slide valve may be spring-loaded and connects said inlet and said outlet with each other in a non-controlled non-operative position and separates said inlet and said outlet from each other in a controlled operative position, said inlet being connected to said fuel supply line and said outlet being connected to said high pressure pump.

The rotation movement of said distributor shaft and a control of said piezoelectric adjustment member are adjusted to each other so that a reversal of said control slide takes place only when said rinsing conduit is separated from said fuel supply line and said fuel return line.

The novel features which are considered ad characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

The single figure of the drawing is a schematic representation of the distributor injection pump according to the invention.

DETAILED DESCRIPTION OF THE PREFERRED EMBODIMENT

The drawing illustrates the principle of the distributor injection pump which can be designed of any suitable embodiment. The distributor injection pump of the invention has a housing 10 which is shown as a portion in cross-section. The distributor injection pump is connected via a fuel supply line 11 with a fuel supply pump 12 and via a fuel return line 13 with a fuel container 14. The fuel supply pump 12 is connected in the known manner via a filter 15 with container 14. The distributor injection pump is connected via injection conduits with four injection valves of which only one injection conduit 16 and one injection valve 17 are shown.

A high pressure pump 18 and a distributor 19 are accommodated in the housing block 10. Both are illustrated in the drawing schematically. The distributor and the high pressure pump of this type have been known and disclosed, for example in EP-OS No. 0074550.

The high pressure pump 18 has a pair of pistons of which only one piston 20 is shown. Each piston 20 is supported by means of a compression spring 23 against a roller pair 21 which is pressed against an inner cam surface of a cam ring 22 positioned in the housing block 10. Ring 22 together with roller pair 21 are shown as turned by 90° in the plane of the drawing. Each piston 20 is guided in a radial bore 24 of a rotating body which is formed of one piece with a distributor shaft 25 of the distributor 19. Radial bores for two pistons are arranged diametrically opposite.

The driven distributor shaft 25 is positioned in a bore 26 of the housing block 10 and has a central passage 27 which at the one side is in connection with a pressure chamber 28 of the high pressure pump 18 and at the other side with a distributor radial bore 29. Four injection channels are arranged as a star around the distributor shaft 25 in the plane of the distributor bore 29 in the housing block 10. Only one such injection channel 30 is shown in the drawing. The injection conduit 16 leading to the injection valve 17 is connected to the injection channel 30. During the rotation of the distributor shaft 25 the injection channel 30 becomes connected via the distributor bore 29 with the pressure chamber 28 of the high pressure pump 18, and a dosed amount of injected fuel is supplied to the respective injection valve 17.

The pressure chamber 28 of the high pressure pump 18 is further connected via a slide valve 31 to the fuel supply 11. The slide valve 31 is integrated in the housing block 10. The slide valve has a valve inlet 32, a valve outlet 33 and a control slide 34 which, at the one side, is loaded with a restoring spring 35 and, at the other side limits a control chamber 36, and is displaceable by a control pressure generated in chamber 36 against the force of the restoring spring 35. The valve inlet 32 and the valve outlet 33 are connected to each other in the ground or inoperative position of the control slide 34 and are separated from each other in the controlled operative position. The valve inlet 32 is connected with the fuel supply line 11 while the valve outlet 33 is connected to the pressure chamber 28 of the high pressure pump. Furthermore, the inlet of a pressure limiting valve 37 also accommodated in the housing block 10 is connected to the valve inlet 32 while the outlet of the pressure limiting valve 37 is connected to the fuel return line 13.

The slide valve 31 is controlled by a piezoelectric adjustment or control member 39 which is comprised in the known manner of a piezo-stack 40, the restoring position of which is effected by a plate spring 43. The piezo-stack received in an inner chamber 42 formed in the housing block 10 is supported against the bottom wall of the chamber 42 at one side, and is connected to the plate spring 43 centrally thereof at the other side. Spring 43 has a disc-shaped rim which is supported against an annular shoulder 44 of the inner chamber 42. The plate spring 43 limits a hydraulic control chamber 38 filled with fuel. Control chamber 38 is in connection with the control chamber 36 of the slide valve 31.

An exiting voltage can be applied to the piezo-stack 40 via an connection conduit 45 whereby the length of the piezo-stack would be increased.

The change in the length of the piezo-stack 40 and also an adjusting path of the piezoelectric control or adjustment member 39 is hydraulically translated via the hydraulic control chamber 38 into a displacement of the control slide 34 in the slide valve 31. The connection between the hydraulic control chamber 38 and control chamber 36 of the slide valve 31 is identified in the drawing by a connection conduit 46.

The distributor shaft 25 of the distributor 19 has, at the distance from the distributor bore 29, control grooves 47 which are spaced from each other at the circumference of the shaft by the same angle and which extend circumferentially over the same distance. The number of control grooves 47 corresponds to the number of the injection valves 17 available, however with the provision of only one injection valve 17 two control grooves 47 must be provided are provided.

Four openings 48–51 are provided in the housing block 10 against the distributor shaft as in the same cross-sectional planes in which the control grooves 47 are formed. The openings or bore mouths 48–51 are formed pairwise. Each pair, namely pair of openings 48, 49 or pair of openings 50, 51 can be connected via the control grooves 47 and also substantially at the same time. By the respective selection of the distance between the openings 48, 49 on the one hand, and openings 50, 51, on the other hand, from each other, the connection between the opening 50 and opening 51, upon the rotation of the distributor shaft 25 is temporarily established before the connection between opening 48 and opening 49 is interrupted. The opening 48 is in connection with the fuel supply line 11 through a bore or conduit 52, and opening 51 is in connection with the fuel return line 13 through a bore or conduit 53 in the housing block 10. A throttle 54 is provided in the bore 53.

Openings 49 and 50 form the beginning and the end respectively, of a rinsing conduit 55 for the hydraulic control chamber 38 from which a bore, forming a first portion 56 of the rinsing conduit leads from the opening 49 to the hydraulic control chamber 38, and a second bore, forming a second portion 57 of the rinsing conduit leads from the hydraulic control chamber 38 to the opening 50.

The arrangement of control grooves 47 on the distributor shaft 25 as well as the arrangement of the cam ring 22 in the housing block 10 for the pistons 20 of the high pressure pump 18 are made relative to each other such that the connection of openings 48–51 via the control grooves 47 is always established then when the high pressure pump 18 is in its fuel suction phase and piston 20 is radially moved in the outward direction. Additionally, the control of the piezoelectric adjustment member is adjusted through the connection conduit 45 to the rotational movement of the distributor shaft so that the reversal of the control slide 34 in the slide valve 31 takes place only when the rinsing conduit 55 is separated from the fuel supply line 11 and fuel return line 13. This separation of the rinsing conduit 55 takes place at the time when the control grooves 47 interrupt the connection between the pairwise openings 48, 49 and 50, 51.

The mode of operation of the distributor injection pump of the invention is as follows:

When the piezoelectric control or adjustment member 39 is non-energized the slide valve 31 takes the position shown in the drawing, which position is a non-operative position in which the valve inlet 32 and the valve outlet 33 are connected to each other. In the exact rotation position of the rotatable distributor shaft 25 shown in the drawing, openings 48–51 are connected to each other through control grooves 47. Piston 20 of the high pressure pump 18 has already passed its outermost radial position so that the pressure chamber 28 and the open slide valve 31 are filled with fuel through the fuel supply line 11 and open slide valve 31 and thereby the fuel suction phase of the high pressure pump 18 has already ended. The rinsing conduit 55 becomes connected through the control grooves 47 with the fuel supply line 11 and the fuel return line 13, and the fuel required by the supply pump flows through the hydraulic control chamber 38 and passes via the throttle 54 and fuel return line 13 again into the supply container 14. The hydraulic control chamber 38 is thereby rinsed with fuel during the suction phase of the high pressure pump 18.

As the distributor shaft 25 rotates further the connection between openings 50 and 51 is first interrupted and later the connection between openings 48 and 49 is also temporarily interrupted. An energizing voltage in form of direct voltage pulses is applied to the piezoelectric control member 39, the duration of this voltage corresponding to the duration of injection. The piezo-stack 40 expands and displaces fluid volumes via the plate spring 43 acting as a diaphragm so that when the rinsing conduit 55 is closed by the connection conduit 46, the displacement of the control slide 34 in the slide valve 31 is effected in the direction of the valve closing. When the slide valve 31 is closed the pressure limiting valve 37 is also separated from the pressure chamber 28 of the high pressure pump 18. An injection pressure is formed by the piston 20 of the pump 18 sliding radially inwardly in the radial bore 24 and the injection valve 17 connected to the pressure chamber 28 by the distributor bore 29 injects fuel due to that pressure.

The application of direct voltage pulses is ended with the end of fuel injection. The piezo-stack 40 assumes under the action of the plate spring 43 its initial length. Under pressure is established in the hydraulic control chamber 38, which underpressure together with the force of the restoring spring 35 moves the control slide 34 in the slide valve 31 in the direction of opening. When the slide valve 31 is open the pressure chamber 28 of the high pressure pump 18 is connected to the pressure limiting valve 37 and thereby pressure in the pressure chamber 28 is reduced in a sudden manner. The injection process is thereby ended.

Upon a further rotation of the distributor shaft 25, piston 20 of the high pressure pump 18 moves again in the radial bore 24 radially outwardly. Thereby fuel is sucked through the open slide valve 31 into the pressure chamber 28. The connection to the injection valve 17 is interrupted, and the control grooves 47 again establish, via the connection of openings 48–51, the connection of the rinsing conduit 55 to the fuel supply line 11 and the fuel return line 13. The hydraulic control chamber 38 is again rinsed.

As the distributor shaft 25 further rotates the above described process is repeated.

It will be understood that each of the elements described above, or two or more together, may also find a useful application in other types of distributor injection pumps differing from the types described above.

While the invention has been illustrated and described as embodied in a distributor injection pump for internal combustion engines, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. In a distributor injection pump for internal combustion engines, especially for diesel motors, comprising a high pressure pump alternatively operated in a suction phase for sucking fuel and a high pressure phase for generating a fuel injection pressure; a distributor for a series connection of the high pressure pump with a plurality of injection valves; a slide valve for determining an amount of fuel being injected. Said slide valve having an inlet and an outlet and a control slide; a piezoelectric adjustment member; and a control chamber provided between said adjustment member and said control slide for a hydraulic translation of an adjustment path of said adjustment member into displacement of said control slide, the improvement comprising a housing; a fuel supply line; a fuel return line; and a rinsing conduit, said rinsing conduit including a first conduit portion connectable with said fuel supply line and opening into said control chamber, and a second conduit portion connectable with said fuel return line, wherein a connection of said rinsing conduit with said fuel supply line and said fuel return line is established during the suction phase of the high pressure pump through said distributor.

2. The pump as defined in claim 1, wherein said distributor includes a distributor shaft rotating with said high pressure pump and having a periphery, said housing having openings arranged at and opening at the periphery of said shaft, a first opening being in connection with said fuel supply line, a second opening being in connection with said first conduit portion, a third opening being in connection with said second conduit portion and a fourth opening being in connection with said fuel return line, said distributor shaft being formed at said periphery with at least two control grooves respectively corresponding to and cooperating with said openings, and wherein in at least one rotation position of said distributor shaft one of said control grooves is connected to said first and said second openings and the other of said control grooves is connected to said third and said fourth openings.

3. The pump as defined in claim 2, wherein said four openings are arranged at said periphery pairwise and a distance between said pairwise-arranged openings, respectively is selected so that, upon rotation of said shaft, a connection between said third and said fourth openings is temporarily interrupted before the connection between said first and said second openings.

4. The pump as defined in claim 2, wherein the number of said control grooves corresponds to the number of said injection valves, said control grooves being spaced at said periphery by an equal rotation angle and each extending circumferentially of said shaft over the same rotation angle.

5. The pump as defined in claim 4, and further including throttle means.

6. The pump as defined in claim 5, wherein said throttle means is formed in said second conduit portion.

7. The pump as defined in claim 5, wherein said throttle means is formed in said fuel return line.

8. The pump as defined in claim 4, further including a plate spring which limits said control chamber, said piezoelectric adjustment member being centrally secured to said spring.

9. The pump as defined in claim 8, wherein said control slide of said slide valve is spring-loaded and connects said inlet and said outlet with each other in a non-controlled non-operative position and separates said inlet and said outlet from each other in a controlled operative position, said inlet being connected to said fuel supply line and said outlet being connected to said high pressure pump.

10. The pump as defined in claim 9, wherein a pressure-limiting valve is provided, which is in connection with said inlet.

11. The pump as defined in claim 10, wherein the rotation movement of said distributor shaft and a control of said piezoelectric adjustment member are adjusted to each other so that a reversal of said control slide takes place only when said rinsing conduit is separated from said fuel supply line and said fuel return line.

* * * * *